166-250 SR
7/29/80 XR 4,214,374

United States Patent [19]
Miotti

[11] 4,214,374
[45] Jul. 29, 1980

[54] METHOD OF AND APPARATUS FOR MEASURING THE DEVIATION OF THE CENTER AXIS OF BORE HOLES AND TRENCHES RELATIVE TO THE DESIGN VERTICAL CENTER AXIS THEREOF

[75] Inventor: Giosuè Miotti, Carpenedo, Italy

[73] Assignee: Comar reg. Trust, Vaduz, Liechtenstein

[21] Appl. No.: 2,154

[22] Filed: Jan. 9, 1979

[30] Foreign Application Priority Data

Nov. 29, 1978 [CH] Switzerland ..... 12228/78

[51] Int. Cl.[3] ..... E21B 47/02; G01C 9/00; E02D 27/00

[52] U.S. Cl. ..... 33/300; 33/1 H; 33/302; 33/304; 33/339; 166/250; 405/267

[58] Field of Search ..... 33/302, 304, 300, 313, 33/339, 1 H; 175/45; 405/267; 166/250

[56] References Cited

U.S. PATENT DOCUMENTS 3,348,315 10/1967 Fontguyon ..... 33/300

FOREIGN PATENT DOCUMENTS 3859 of 1901 United Kingdom ..... 33/304

*Primary Examiner*—Steven L. Stephan
*Attorney, Agent, or Firm*—Karl W. Flocks

[57] ABSTRACT

A method of measuring the deviation of the run of the actual vertical center axis of fluid filled bore holes and trenches relative to the direction of the design center axis thereof which bore holes and trenches are excavated under bentonite slurry comprises inserting into said bore holes and trenches a gauge means suspended from a cable means, whereby said gauge means is arrested inside said bore hole at any desired level, and thereafter a measuring cable means is connected to said gauge means and substantially tensioned and brought to run in an exact vertical direction whereupon above ground level the horizontal deviation of said cable means from the design center line of said bore hole or said trench is measured. An apparatus for carrying out said method comprises a gauge means arrestable inside said bore hole or said trench, a cable means for suspending and controlling said gauge means, a supporting frame means for supporting said cable means and said gauge means, a tensioning device to apply a tension force at one end of said cable means and an instrument means to control the verticality of said cable means.

17 Claims, 10 Drawing Figures

METHOD OF AND APPARATUS FOR MEASURING THE DEVIATION OF THE CENTER AXIS OF BORE HOLES AND TRENCHES RELATIVE TO THE DESIGN VERTICAL CENTER AXIS THEREOF

BACKGROUND OF THE INVENTION

1. Field of the Invention

The present invention relates to a method of measuring the deviation of the run of the actual vertical center axis of fluid filled bore holes relative to the direction the design center axis thereof, the excavation of said bore holes and trenches proceeding by utilization of a bentonite fluid filling substantially completely said bore holes and said trenches such to back the side walls of said bore holes and said trenches to prevent a cave-in thereof, said method comprising an insertion of a measuring cable means into said bore hole or said trench whereby the lower end of said measuring cable means inside said bore hole or said trench is aligned at a first horizontal measuring plane with the center of said bore hole or said trench and thereafter at a predetermined point in a second horizontal measuring plane at or above ground level the horizontal deviation of the position of said measuring cable means relative to the run of the true vertical design centerline of said bore hole or trench is determined. The present invention relates further to an apparatus for carrying out said method.

2. Description of the Prior Art

Vertical bore holes and trenches of variable cross-sectional sizes and variable depths are excavated into soil with the use of bentonite slurry to realize underground structures known as diaphragm walls. Said bore holes or sections of trenches are excavated and then cast with concrete or another suitable building material one after the other to form a continuous underground wall of considerable depth such as up to e.g. 400 feet. During the excavation such bore holes or trenches are kept filled with bentonite slurry, having the function of supporting the soil, i.e. the inner side walls of the bore holes or trenches such to prevent a cave-in thereof.

In many instances said underground walls must be installed with an extremely high accuracy regarding their vertical alignment. To this end specialized trenching equipment is used and particular excavation methods are adopted.

However, as the excavation proceeds periodic measurements of the verticality of the bore hole or trench are required to detect any tendency of a deviation of the centerline of the excavated portion of the bore hole or trench from the true vertical line such that if necessary timely appropriate measures can be taken to rectify wrong alignments.

Obviously, the accuracy in keeping the vertical alignment depends, apart from the excavation procedure itself, also substantially from the accuracy of the measurement of the deviation itself. Therefore, if strict or severe tolerances regarding the verticality are imposed it is of paramount importance that the method and apparatus utilized for measurements as to the verticality are such that a high degree of accuracy of the measurement itself is guaranteed.

The prior art knows various methods for the measuring of the vertical alignment of a bore hole. Most of these known methods are, however, developed and suitable for measurements in bore holes of a rather small diameter relative to their depths. The methods use instruments which can measure the angle of deviation from the true vertical of the actual centerline of the bore hole, at the depth where such instruments are placed, as well as the direction of the horizontal projection of the same bore hole centerline.

In order to locate the exact three-dimensional position of the center at the bore hole bottom a succession of several measurements at short intervals along the length of the bore hole is required. However, with such method the accuracy in the positioning is to a large extent affected due to the high number of measurements involved.

Furthermore, it has been experimented that if a measurement cable is immersed in a viscous fluid such as bentonite slurry and is tensioned vertically, the perfect alignment of said cable with the true vertical is reached asymptotically in a rather long time due to the reaction or resistance of the fluid which opposes the horizontal movement of such cable.

The time span required by a given cable to stabilize itself in the final position is a function of its length, its diameter and the tensioning force applied at this cable. In order to reduce the time span for conducting the measurement and to increase the accuracy of the position of the cable it is desirable to reduce the diameter of the cable itself or to increase the tensioning force acting on such cable.

The methods of the prior art have not considered the tensioning force of the cable as relevant because of the general low accuracy of the known procedures. In the known methods the the measurement cable is simply kept in tension by a weight device suspended to it, such as a plumb. For practical reasons the weight of such device cannot exceed about one-half of the breaking strength of the cable, such that the tensioning thereof is quite limited and the measurement carried out thereby inaccurate and time consuming.

In the known methods, such as described above, where the tensioning force acting on the cable is rather low, to measure the verticality of the cable this must be at sight for a rather long length, which means that it has to be suspended high above ground level. The measurement is then made by means of a theodolite instrument, placed in two positions in orthogonal alignment with the cable.

SUMMARY OF THE INVENTION

An object of the invention is to provide a method of measuring the deviation of the run of the actual center axis of fluid filled bore holes or trenches relative to the direction of the design center axis thereof, the excavation of said bore holes and trenches proceeding by utilization of bentonite fluid filling substantially completely said bore holes and said trenches such to back the side walls of said bore holes and said trenches to prevent a cave-in thereof, said method comprising an insertion of a measuring cable means into said bore hole or said trench whereby the lower end of said measuring cable means inside said bore hole or said trench is being aligned at a first horizontal measuring plane with the actual center of said bore hole or said trench and thereafter at a predetermined point in a second horizontal measuring plane at or above ground level the horizontal deviation of the position of said measuring cable means relative to the run of the design centerline of said bore hole or trench is determined, whereby in that said lower end of said measuring cable means is locked or arrested in position at said first horizontal measuring plane, thereafter a controlled tension force is applied at the opposite end of said measuring cable means positioned above ground level such to establish a substantial tensile stress in said measuring cable means, whereby further said measuring cable means is positioned to run in a true vertical direction and thereafter the extent and direction of the deviation of said measuring cable means relative to the design centerline of said bore hole or trench is determined in said second horizontal measuring plane.

A further object is to provide an apparatus for carrying out aforesaid method, comprising a gauge means arrestable inside said bore hole or said trench, a cable means for suspending and controlling said gauge means, a supporting frame means for supporting said cable means and said gauge means, a tensioning device means to apply a predetermined tension force at one end of said cable means and an instrument means to control the verticality of said cable means.

According to a preferred embodiment the cable is tensioned by a force up to 4/5ths of its breaking strength, such that a higher accuracy can be achieved with a smaller length of cable in sight, approximately 1 meter, and with a highly sensitive measuring instrument.

Thus the cable moves extremely fast into an exact vertical extent in spite of the resistance of the bentonite slurry against a horizontal movement of the therein immersed cable, such that the time span used for carrying out the measurements is considerably reduced.

BRIEF DESCRIPTION OF THE DRAWINGS

The present invention will be more fully understood by reference to the following detailed description thereof, when read in conjunction with the attached drawings, and wherein.

DETAILED DESCRIPTION OF THE PREFERRED EMBODIMENT

Figure 1:
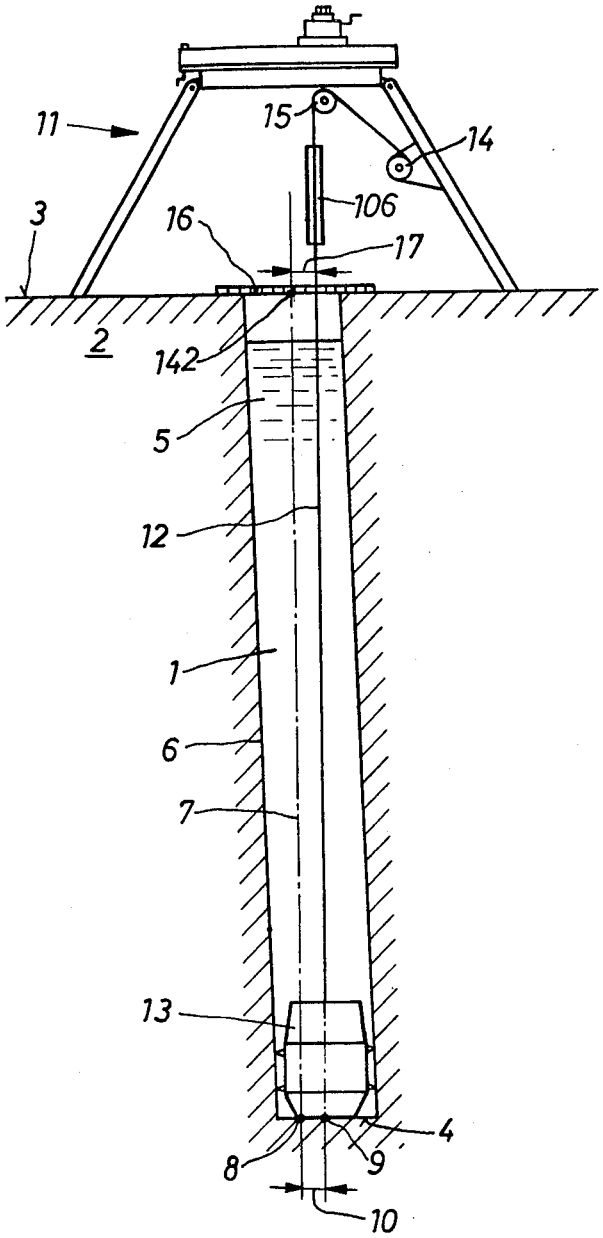
FIG. 1 is a schematic view of a vertical cross-section of an apparatus for measuring the verticality of the center axis of a bore hole or trench.

Referring to FIG. 1, there is shown a vertical section orthogonal to the longitudinal axis of the diaphragm wall to be constructed. There is shown a trench or bore hole 1 excavated into the ground 2. Reference numeral 3 denotes the ground level. The bottom 4 of the trench 1 defines a first horizontal measuring plane, the purpose of which will be explained later on. As the excavation proceeds, the trench is kept filled in a known manner with bentonite slurry 5 which prevents a cave-in of sections of the side walls 6 of the trench 1. The theoretical true vertical design centerline of the trench 1 is denoted by the reference numeral 7. This design centerline 7 coincides at ground level 3 exactly with the center of the actually excavated trench 1. FIG. 1 depicts, however, a trench 1 which does not extend correctly and vertically into the ground 2. The error is shown such that the trench 1 is somewhat slanted to the right hand side of the drawing sheet. Thus the design centerline 7 intersects the bottom 4 of the trench at a point 8 which obviously does not coincide with the actual center 9 of the bottom 4 of the falsely excavated trench 1. Thus there exists a horizontal displacement 10 of the actual center 9 relative to the theoretical center 8 of trench 1.

It is of course not possible to measure this displacement 10 and the bottom 4 of the trench 1 filled completely with bentonite slurry 5.

In order now to measure this displacement 10 the trenching operations are suspended and the trenching tools (not shown) removed from the trench 1.

A carrier frame 11, which will be described in detail later on, is placed onto the ground 2 straddling the trench 1. From this frame 11 there is suspended a wire cable 12 which carries a gauge 13. This gauge 13 is placed upon the bottom 4 of the trench 1 by lowering it down by means of the wire cable 12. Thereupon the wire cable 12 is tensioned by a winch to the desired force or tension by utilization of a tension dynamometer and located in a true vertical position as indicated with the reference numeral 12 by adjusting horizontally the position of a guide pulley 15 suspended from the frame 11, whereby the suspension and particulars of the movement of said guide pulley 15 will also be described in detail later on. The verticality of the wire cable 12 is measured or ascertained by an instrument device 106 fastened to the wire cable 12.

As soon as the tensioned wire cable 12 runs exactly vertically as measured with mentioned instrument device 106, a system of surface marks 16 extending across the trench 1 will allow the measurement of the length 17 of the horizontal deviation at ground level 3 considered as a second horizontal measuring plane. This length 17 corresponds exactly to the projection of the displacement 10 of the center 9 of the trench bottom 4 from the design center 8.

The same procedure is then repeated with reference to a vertical section along the longitudinal line of the diaphragm wall axis, such that finally two lengths 17 of deviation measured orthogonally to each other in a horizontal plane are obtained. The depth of the trench 1 is easily measured at the wire cable 12. These three measured figures give finally the exact three-dimensional location of the center 9 of the bore hole bottom 4 or its deviation from the design center 8, respectively.

Figure 3:
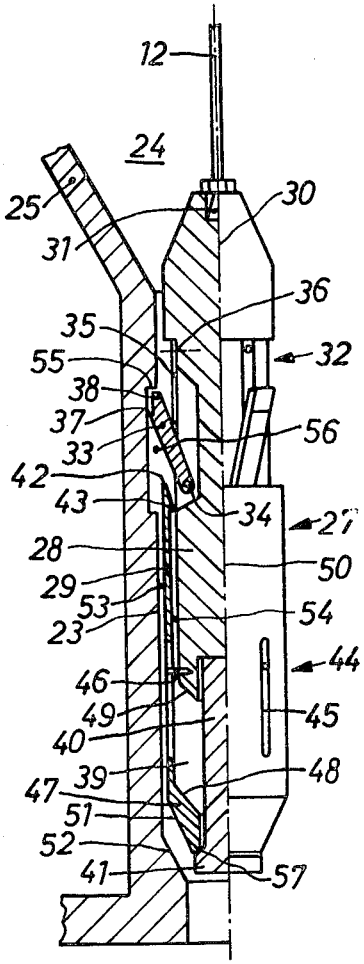
FIG. 3 is a vertical section of a plug means inserted into the main body shown in FIG. 2, whereby only a part of this main body is shown.
Figure 2:
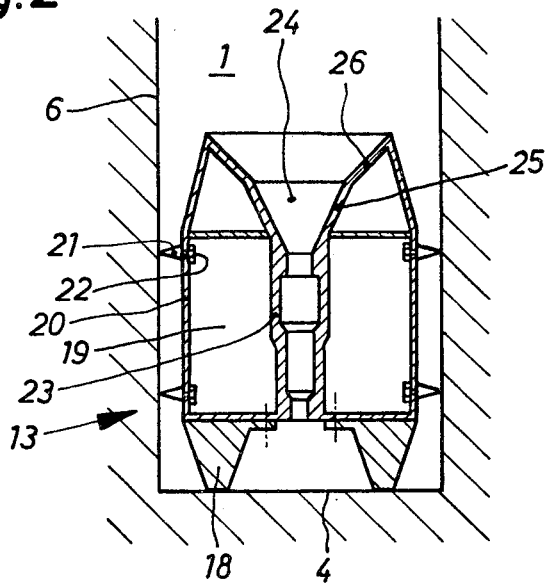
FIG. 2 is a vertical section of a main body of a gauge means located at the bottom of a bore hole or trench.

Reference is now made to FIGS. 2 and 3, showing a first embodiment of the gauge 13, and whereby the placing of the gauge 13 into the trench or bore hole 1 and tensioning of the wire cable 12 will be described.

It has been mentioned earlier that in order to carry out exact measurements the wire cable 12 must be as thin as possible and be subjected to a tensioning to about 4/5 of its breaking force. This is because the bentonite slurry resists any horizontal movement of the wire cable 12; thus it firstly would take a long time for the wire cable 12 to move into an exact vertically running position and if a tensioning force is not great enough it will be not even certain if the cable runs along a straight line or if there are bends in the cable making exact measurements impossible.

The gauge 13 shown in FIG. 2 as placed on the bottom 4 of the trench 1 is a metal plate construction having supporting feet 18 bolted to the hollow body 19. The side walls 20 of the body 19 are provided with rubber spacers 21 which keep the gauge 13 centered in the trench 1 or bore hole. The spacers 21 allow also the bentonite slurry to flow around the body 19 during its insertion into or extraction out of the trench 1. The spacers 21 are mounted by means of screw bolts 22 to the side walls 20 such that the extent of projection of the spacers 21 can be individually altered to suit possible variations of the trench or bore hole diameter or different conditions of the side walls 6 of the trench or bore hole. To this end several sets of spacers 21 of varying length are provided, which are exchangeable among each other.

The center of the body 19 comprises a through bore forming a socket 23, the particulars of which will be described later. The upper section 24 of the body 19 is formed by diverging or flaring, respectively, side wall sections 25, 26 defining a guideway for a plug 27 which is to be inserted into said socket 23.

This plug 27 is shown in FIG. 3. The plug 27 comprises a cylindrical main body 28 partly received in an outer shell 29, which is axailly movable relative to the main body 28. The upper end 30 of the body 28 is connected to or suspended from, respectively, the wire cable 12, whereby the end of this wire cable is provided with a cone 31 by means of which the wire cable 12 is coupled in a known way to the upper end 30 of the main body 28. The main body 28 comprises furthermore a section 32 of reduced diameter. A number of pawls 33, in this particular embodiment three pawls 33, are at their lower ends by 34 hingedly connected to the main body 28 at the lower end of the section 32 of reduced diameter. The pawls 33 are shown in their extended position projecting obliquely out of the main body 28 and are rotatable from this position into a further position in which they extend about parallel to the main body 28 and are substantially completely received in mentioned section 32 of reduced diameter. Adjacent the upper end of section 32 of reduced diameter a number of leaf springs 35 is bolted at points 36 to the main body 28. There is arranged one leaf spring 35 each for every pawl 33, which leaf spring 35 extends between the main body 28 proper and the corresponding pawl 33 and substantially parallel to the main body 28. As is obvious out of FIG. 3 each leaf spring 35 biasses its corresponding pawl 33 into the position projecting obliquely away from the main body 28. Each pawl 33 is roughly in the form of a plate and is provided at its outer side with a shoulder 37 and comprises furthermore an end face 38. The main body 28 is furthermore provided with a lower section 39 of reduced diameter which in fact is a separate cylindrical member 40 inserted into and fixedly mounted to the body 28, which member 40 is provided with an end flange 41 forming a lower stop for the outer shell 29.

This outer shell 29 comprises an upper rim 42 provided with an inwardly extending latch-like projection 43. An intermediate section 44 of the generally cylindrical outer shell 29 comprises a plurality of axially extending slots 45, in which slots each a pin 46 projects, which pin 46 is secured to the main body 28 and thus allows an axial sliding movement of the shell 29 relative to the main body 28 but prevents a relative rotating movement between these two parts. The lower end of the outer shell 29 comprises an inwardly extending projection 47 entering into said lower section 39 of reduced diameter.

The inner upper face 48 of this projection 47 extends obliquely to the longitudinal extent of the main body 28 or shell 29, respectively. The surface section 49 defining the upper end of the reduced section 39 of the main body 28 extends likewise obliquely, however, at a different angle to longitudinal center axis 50 of the body 28. Also, the outer lower face 51 of the projection 47 extends obliquely as does the inner corresponding wall section 52 of the socket 23 formed in the body 19 of the gauge 13. Again the two surface sections 51 and 52 do not run exactly parallel to each other. And in this context it is to be noted that there exists a space 53 between the outer wall of the shell 29 and the inner wall of the socket 23 and a further space 54 between the inner wall of the shell 29 and the outer surface of the main body 28. Thus there are at any place spacings between surfaces and walls movable relative to each other and only line and no area contacts. This is of importance because it must be borne in mind that the entire gauge 13 must safely operate under the viscous bentonite slurry which in case of relative movements must be allowed to freely flow due to displacements forced thereupon by moving parts of the gauge, i.e. socket and plug.

The operation of the gauge 13 of the embodiment of FIGS. 2 and 3 is as follows. It has been mentioned earlier that the wire cable 12 will be tensioned up to 4/5 of its breaking strength in order to ensure a true vertical run in the bentonite slurry and to ensure a speedy movement of the wire cable 12 into this position. In order to carry out repeated measurements it is obviously not safe to use such a thin wire cable repeatedly to move the gauge 13 and a safe arresting of the lower cable end in the trench 1 moved also not be achievable.

Accordingly, two wire cables 12 are utilized in this embodiment, namely a service cable and a measuring cable proper. And furthermore, the weight of the gauge 13 is chosen great enough that it exceeds the breaking strength of the measuring cable 12 such that any tension can be applied at the cable 12 without inducing a lifting of the gauge 13 placed on the bore hole or trench bottom.

Returning now to FIGS. 1, 2 and 3 the first step of the operation proceeds as follows.

After having removed the trenching equipment the carrier frame 11 is placed over the trench 1. On this carrier frame 11 there is suspended by means of a strong service wire cable 12 the gauge 13 comprising the body 19 into the socket 23 of which there is inserted the plug 27 connected to the wire cable 12. The position of the plug 27 relative to the socket 23 and of the moving parts of plug 27 is at mentioned condition in accordance with the positions shown in FIG. 3.

Accordingly, the pawls 33 are in their extended position engaging with their end faces 38 into the shoulders 55 defining the upper end of a section 56 of enlarged inner diameter of the socket 23. The pawls 33 engage also at their shoulders 37 into the socket side walls. The weight of the hollow body 19 acting on the pawls 33 urges these pawls 33 outwardly such that the hollow body 19 is securely suspended via the pawls from the plug 27. Due to its own weight the outer shell 29 of the plug 27 is in its lowest position abutting with its lower rim 57 of projection 47 the end flange 41.

The parts being in above described position the service cable 12 is lowered down into the trench 1 until the feet 18 of the gauge 13 contact the bottom 4 of the trench 1. In this condition the body 19 rests on said bottom 4. Following, the wire cable 12 is given a slack, is thus lowered further down. Thus, the plug 27 will descend further within the arrested socket 23. Upon a further descending of the plug 27 along a short distance the lower face 51 of the projection 47 at the lower end of the outer shell 29 will come to rest upon the wall section 52 of the lower converging part of the socket 23. The main body 28 of the plug 27 being lowered further, the shell 29 will now remain stationary and accordingly an axial relative movement between shell 29 and the main body 28 will occur. The projection 47 of the outer shell 29 will thus move relatively upwards inside the lower section 39 of reduced diameter of the main body 28 until the upper face 48 of the projection 47 contacts the under surface section 49 of the main body 28. It is here to be mentioned that conclusively the outer shell 29 is movable a predetermined distance axially of the main body 28, the extent of movement being defined by the axial length of section 29.

Returning now to the operation, as soon as the outer shell 29 moves along the main body 28 its upper section will come to bear against the projecting pawls 33 thus forcing them back against the action of their respective leaf springs 35. This axial movement of the shell 29 relative to the main body continues until the end flange 41 hits the bottom 4 or the upper face 48 of the projection 47 of the shell 29 abuts surface section 49 of the main body 28. The shell 29 overlies now completely the pawls 33. Upon a small retroactive movement of the main body 28 the shoulders 37 of the pawls 33 come to abut the latch-like projections 43 of the upper rim 42 of the shell and engage into said projections 43 and biassed by the leaf springs 35 against the upper rim 42 thus kept in engagement with the latch-like projections. In this position the plug 27 and thus service cable 12 is pulled out and retrieved from trench 1. Following this the thin measuring cable 12 having a or the same plug 27 at its end is lowered into the trench 1. Thereby the pawls 33 are in their extended position. When the plug 27 has entered into the socket 23, care is taken that it is not lowered completely down to the bottom 4, which is an easy task achieved by e.g. marks painted on the cable 12, determined from the measured depth by means of the previous service cable.

The end faces 38 of the pawls 33 engage into the shoulders 55 of section 56 with enlarged inner diameter; thus the plug 27 is securely fixed in the socket 23 such that the tensioning of the measuring cable 12 can be carried out and the further operations of centering the cable 12 and measuring of the deviations can be carried out, such as will be described later on.

After the measurements have been carried out, the measuring cable 12 is lowered further down into the trench 1 following in a disengagement of plug 27 from the socket 23 as described above, allowing the retrieval of measuring cable 12 and plug 27.

Thereafter, the service cable 12 is lowered with its plug 27 into the trench 1, the latter brought into engagement with the socket 23 as has been the case with the measuring cable. Finally, the service cable 12 is retrieved, whereby the plug 27 with its pawls 33 kept in engagement with the shoulders 55 of the hollow body 19 is raised such that the complete gauge 13 is removed out of the trench 1 and excavating can proceed further, possibly carrying out some corrections in the trench 1 in accordance with the measured values.

Figure 4:
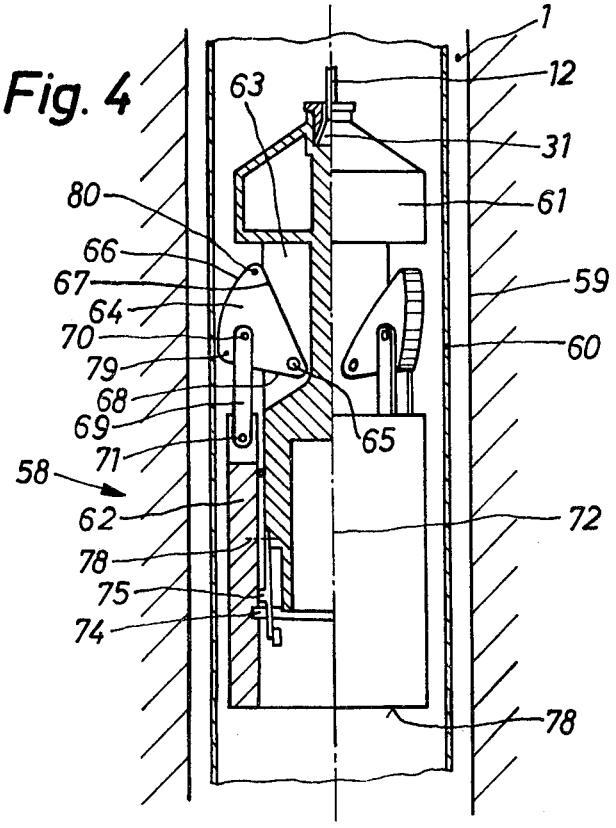
FIG. 4 is a vertical section through a gauge means which clampingly engages into side wall sections of the bore hole or trench.

Referring now to FIG. 4 there is shown a further embodiment of the gauge, identified by the reference numeral 58. This gauge 58 is specifically suitable if the verticality of only a section of the trench or bore hole shall be measured, e.g. in case of a bore hole having a bend halfway to its bottom and if is desired to obtain information at which level this bend begins.

The embodiment of the gauge 13 shown in FIGS. 2 and 3 as well as the embodiment of the gauge 58 of FIG. 4 can both be used for measuring out trenches as well as for measuring out bore holes, although gauge 13 will preferably be used in trenches and gauge 58 will preferably be used in bore holes. Thus the exemplary description of gauge 58 refers to an application in a lined bore hole 1.

In FIG. 4 there are shown the bore hole walls 59 as well as a liner 60, e.g. a metal tube. The gauge 58 comprises a main body 61 which is partly received in an outer shell 62. The main body 61 is suspended from a wire cable 12, which has again a cone 31 at its lower end with which it is coupled to the main body 61 in a known way. The cylindrical main body 61 comprises a section 63 of reduced diameter. A plurality of clamping plates 64 are hingedly connected at a hinge point 65 to said section 63 of reduced diameter to the main body 61 such that they can be expanded and retracted retlative to the main body 61. These plates 64 are of a triangular configuration with rounded corners whereby the hinge point 65 is in the area of one of the corners. One face 66 of each clamping plate 64 defined by a side line of the triangle extends convexly bent and the other two side lines 67, 68 extend substantially in a straight line. A linkage member 69 each at one end is hingedly mounted at a hinge point 70 to each clamping plate 64. The other or lower, respectively, end of each linkage member 69 is hingedly mounted to the outer shell 62 at a hinge point 71. Because the distance between the axial centerline 72 of the main body 61 and the first hinge point 65 is smaller than the corresponding distance between centerline 72 and hinge point 70 it is obvious that due to the weight of the outer shell 62 suspended from the clamping plates 64 these clamping plates 64 are biassed in their extended position as shown in FIG. 4. The outer shell 62 is kept in alignment with the main body 61 by means of spacers 73 mounted along the circumference thereof.

The outer shell 62 is provided adjacent to its lower end with an inner circumferential groove 74. The main body 61 in turn is adjacent to its lower end provided with projections 75 formed one each on a leaf spring 76 each mounted in turn at 77 to the main body 61. Accordingly, the projections 75 are due to the leaf springs 76 biassed away from the main body 61.

The operation of this embodiment is as follows, whereby only one wire cable 12 is used.

The gauge 58 is lowered down the bore hole 1 until to the required level which is not identical to the bore hole bottom. This level defines the first horizontal measuring plane 78 defined through the lower edge of outer shell 62.

During the lowering of the gauge 58 the clamping plates 64 forced by the weight of the outer shell 62 away from the main body 61 abut slightly the liner 60. As soon as the gauge has reached the required depth the lowering is stopped and a reverse pull exerted at the wire cable 12.

It is now to be noted that the lower end apex 79 of the curved side surface 66 of the triangular clamping plates is closer to its hinge point 65 than the corresponding upper apex 80.

If now the main body 61 gets pulled back the clamping plates 64 held at the first instance in frictional engagement with the liner 60 due to the weight of the outer shell 62 begin to roll along the arcuate face 66 on the liner 60 and thus will abut under exertion of pressure said liner 60 and accordingly will lock in the bore hole 1. The higher the upwards pulling force of wire cable 12 is the more the clamping plates 64 will lock in place such that the measurements regarding the verticality as will be described later on can be carried out.

After termination of the measurements the gauge 58 is lowered down to the bottom of the bore hole. There, at the lower edge 81 of the outer shell 62 it will come to rest and the inner main body 61 will continue its descent until the spring biassed projections 75 snap into the inner circumferential groove 74 of the shell 62. Quite obviously the clamping plates 64 will rotate away from the liner 60 as soon as the inner main body 61 moves downwards relative to the outer shell 62, such that a downwards movement of the entire gauge 58 is always possible.

The main body 61 now is locked to the outer shell 62, and thus the clamping plates 64 are locked in their retracted position such that the gauge 58 can freely be pulled out of the bore hole such that excavating (or drilling) can proceed.

Figure 5:
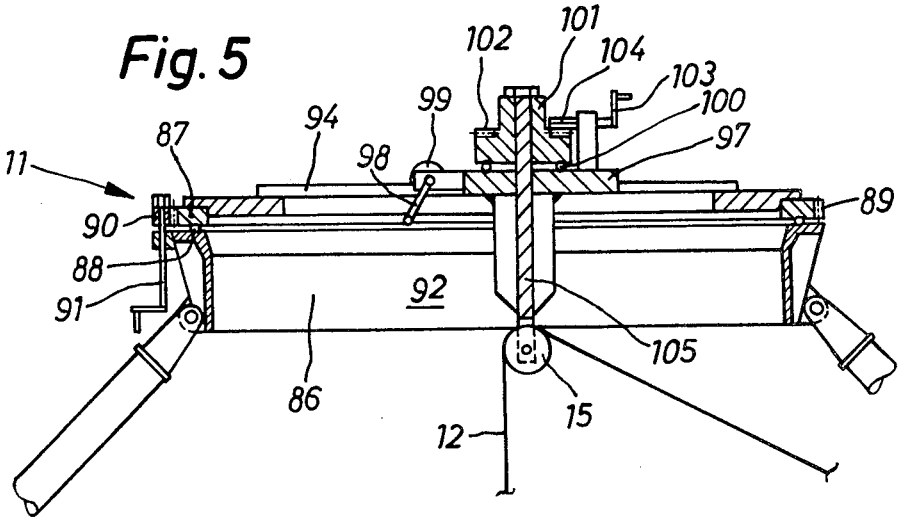
FIG. 5 is a vertical section through a supporting frame means.
Figure 6:
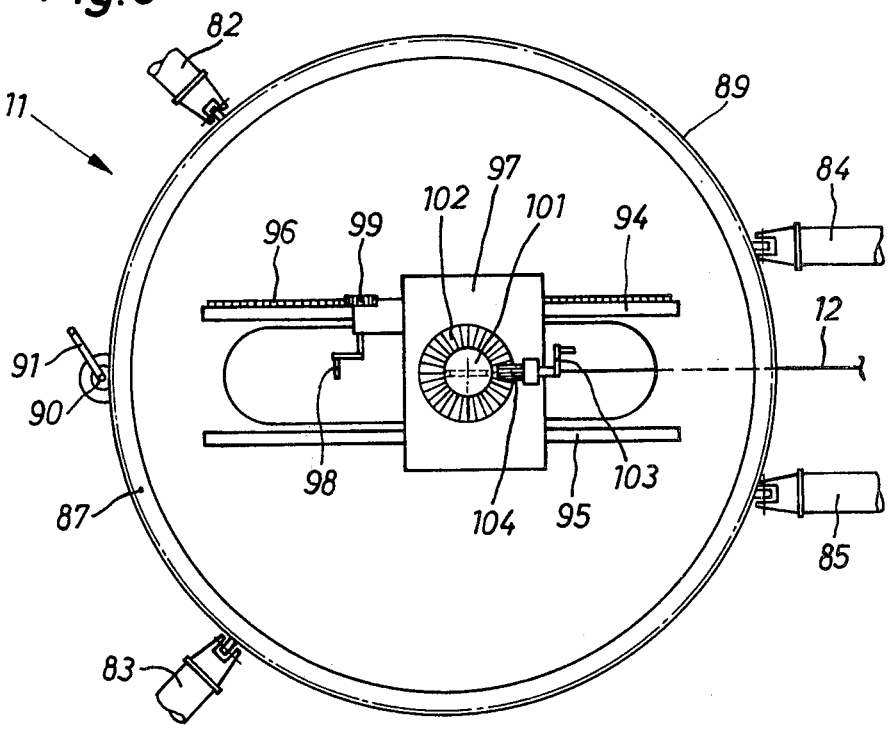
FIG. 6 is a planar view of the supporting frame means of FIG. 5.

The carrier frame 11 shown in FIG. 1 is designed in detail in FIGS. 5 and 6. As mentioned earlier the carrier frame 11 supports a guide pulley 15 for the wire cable 12. The wire cable 12 ends at a hand operated winch 14 of common design (see FIG. 1) and thus not closer described or shown in FIGS. 5 and 6.

The carrier frame 11 comprises four legs 82, 83, 84, 85, whereby the legs 84, 85 extend parallel and close to each other and carry the winch 14. Each of these legs 84, 85 are hingedly connected to a circular base plate 86. The base plate 86 carries a first turntable 87 resting on a first ball bearing device 88 carried by the base plate 86. The first turntable 87 is provided with a toothed rim 89. The base plate 86 carries a gear pinion 90 meshing with the toothed rim 89 and connected to a hand operated crank handle 91. Thus, rotating the crank handle 91 will cause a rotation of the first turntable 87 relative to the base plate 86.

The base plate 86 is an annular construction having a large central opening 92 and the first turntable 87 has an elongated opening 93 extending along a diameter of the turntable 87. This opening 93 is flanked by elongated slide rails 94 and 95. Along slide rail 94 there extends a toothed rack 96. These slide rails 94 and 95 support and guide a slide 97. This slide 97 is provided with a further crank 98 driven toothed pinion 99 supported by the slide 97 and meshing with the toothed rack 96. Accordingly, by turning the crank 98 the slide 97 can be moved back and forth along the slide rails 94, 95.

The slide 97 supports in turn by the intermediary of a second ball bearing device 100 a second turntable 101. Turntable 101 is provided with an annular toothed rack 102, and slide 97 is provided with a crank 103 operated toothed pinion 104 meshing with rack 102. The second turntable 101 comprises a suspension frame 105 rigidly connected to the turntable 101 and thus rotatable therewith. This suspension frame 105, finally, supports the guide pulley 15.

When now the measurements are carried out, the carrier frame 11 is placed over the trench 1 or bore hole, and the gauge 13 or 58, respectively, lowered down in the trench or bore hole, and finally the wire cable 12 will be tensioned by operating the winch 14 in reverse, upon which the wire cable 12 or measuring cable, respectively, is brought into an exact vertically extending direction.

To this end the guide pulley 15 must be moved in a horizontal plane and must be movable in any direction. This is possible due to the rotational movement of the first turntable 87 and the superimposed longitudinal movement of slide 97.

The second turntable 101 serves not basically for adjusting table 12 to extend in a true vertical direction. It serves basically for rotating the guide pulley 15 if the first turntable 87 is rotated such to keep the pulley 15 aligned with the portion of the wire cable 12 extending between guide pulley 15 and winch 14 because the vertical plane in which the guide pulley 15 extends must also contain above mentioned portion of the wire cable 12 in order that the suspension frame 105, and consequently the complete suspension apparatus will only be subject to a force in vertical direction. A misalignment between guide pulley 15 and wire cable 12 will cause the cable 12 to jump out of the pulley 15 or the frame 11 to tip over.

Referring now to FIGS. 7, 8, 9 and 10 there will be explained the instrument device 106 to measure the verticality of the wire cable 12, which device 106 is to be attached to the wire cable as schematically shown in FIG. 1.

First of all, it is to be noted that the entire instrument device is split in its axial or longitudinal, respectively, direction such that it is possible to mount or clamp it to the wire cable 12 when the gauge 13 or 58, respectively, has already been lowered down into the trench or bore hole, respectively.

Figure 7:
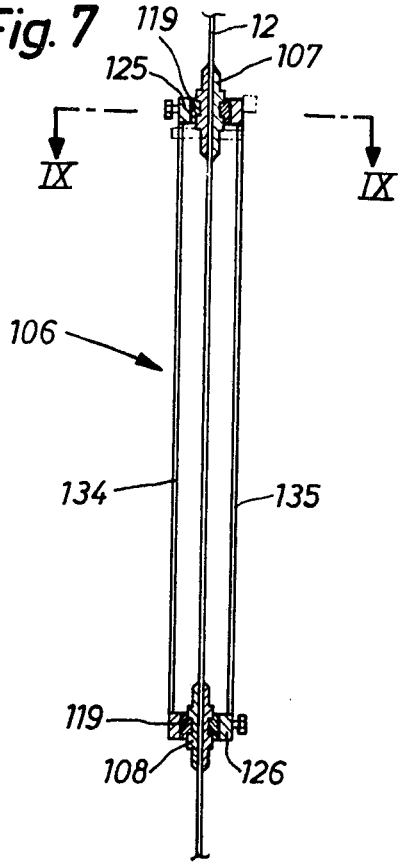
FIG. 7 is a section through an instrument means to control the verticality of the measuring cable.
Figure 8:
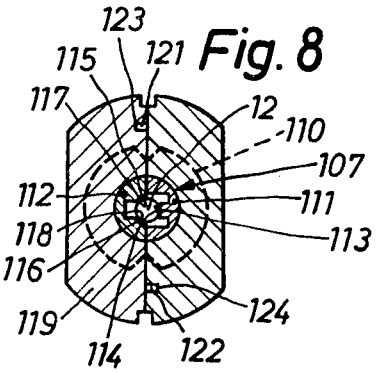
FIG. 8 is a section along the line VIII—VIII of FIG. 10.
Figure 10:
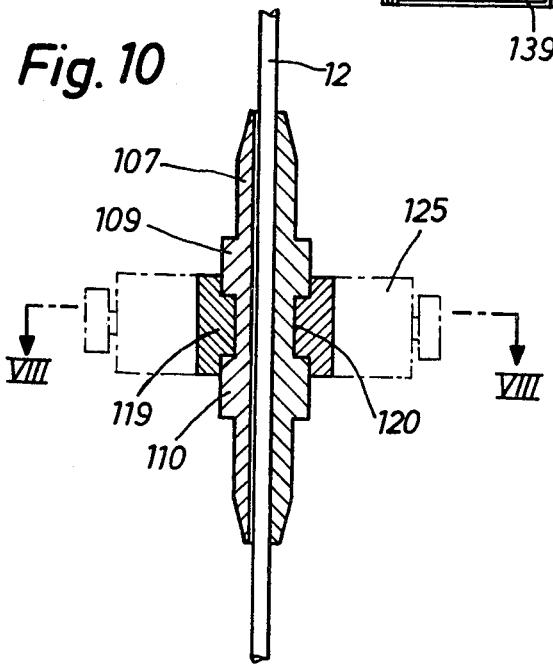
FIG. 10 in an enlarged scale is a vertical section of a fastener means and an insert means.

This instrument means comprises two identical elongated fastener elements 107, 108 shown schematically in FIG. 7 and more in detail in FIG. 10 and in section in FIG. 8. Each fastener element 107, 108 is an axially split elongated body having two spaced circumferential guide ribs 109, 110, the function of which will be described later.

In FIG. 8 there is shown a view of a cross-section through the fastener elements 107, 108 along line VIII—VIII of FIG. 10, whereby the axially split disposition of the fastener elements 107, 108 is discernible. Accordingly, the two halves 111, 112 making up one fastener element 107, 108 are not of identical design as far as their center area is concerned. The first half 111 comprises one inner projection 113 having a machined surface 114. This machined surface 114 has a width corresponding to one-half of the diameter of the wire cable 12 and an axial length of 30 times the diameter of the wire cable and engages the wire cable 12 upon attaching or clamping, respectively, the instrument device thereto. The second half 112 of each fastener element 107, 108 comprises two projections 115, 116, whereby projection 115 has a machined surface 117 and projection 116 has a machined surface 118. Obviously, the width and length of projections 115, 116 correspond to the width and length of projection 113. Thus, the contact between the wire cable 12 and each fastener element 107, 108 consists of three machined surfaces.

The center portion of each fastener element is surrounded by a likewise split oblong the guide member 119 engaging into the guide ribs 109, 110 and the axial space 120 therebetween. The guide member halves are located relative to each other by projections 121, 122 projecting into corresponding recesses 123, 124.

Figure 9:
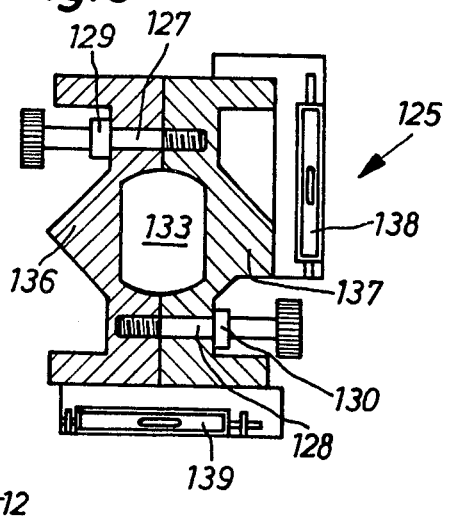
FIG. 9 is a section through a clamping means provided with levels.

The fastener elements 107, 108 are clamped onto the wire cable 12 by means of a clamping device 125, 126, each acting via guide members 119 onto the fastener elements 107, 108. Such clamping device 125 is shown in FIG. 9.

The clamping device 125 or 126, respectively, is again an axially split member, the two halves being held together by two threaded bolts 127, 128, having a shoulder 129, 130 each as well as knurled heads 131, 132.

Each clamping device comprises a central opening 133 corresponding to the outer shape of guide member 119. Obviously, when clamping the instrument device 106 to the wire cable 12 the clamping devices 125, 126 will clampingly engage the guide members 119 clamping in turn the fastener element 107, 108 to the wire cable 12.

It is to be noted that the guide members 119 are shaped such that the fastening elements 107, 108 can rotate up to an angle of 5 seconds from the vertical.

Furthermore, the tightening force of the threaded bolts 127, 128 is fixed by means of mentioned collars or shoulders 129, 130 such that the friction resistance between the wire cable 12 and the fastener elements 107, 108 is 1.5 times the weight of the instrument device 106, which is generally considered the most appropriate tightening force to hold the instrument device in position without giving rise to deformations of the wire cable which could influence the accuracy of the measurement.

Reverting now again to FIGS. 7 and 9 it is shown that the two clamping devices 125, 126 are rigidly connected to each other by frame members 134, 135. Frame member 134 is rigidly connected to area 136 of the left half of the respective clamping device and frame member 135 is rigidly connected to area 137 of the right half of the respective clamping device.

The two clamping devices 125, 126 are of a similar design with the exception that the upper clamping device 125 comprises additionally two water levels 138, 139 or bubble tube levels, respectively, with a two-second sensibility extending horizontally and orthogonally to each other such to indicate when the wire cable 12 has reached its vertical position. The levels 138, 139 are provided with suitable zero-adjusting screws 140, 141. Prior to its use the instrument device has to be calibrated on a plumbed cable.

In use, when gauge 13 or 58 has been arrested in the bore hole 1 and the tension applied to wire cable 12 by a reverse rotation of winch 14 and the measuring device 106 clamped to wire cable 12, then the measuring cable 12 is by operating the movable elements of carrier frame 11 such as described earlier brought to extend in an exact vertical direction.

This state is shown in FIG. 1. Here the design center of the trench 1 at ground level defining the second horizontal measuring plane is indicated with reference numeral 142. Because now the trench or bore hole extends slanted, the vertical projection of the design center 142 on the bore hole bottom 4 (first horizontal measuring plane) is at 8, which obviously does not correspond to the actual (false) center point 9, whereby the deflection is shown by means of reference numeral 10, the distance of which being now measured at ground level. A measuring ruler comprising the surface marks 16 is placed on the ground and intersecting the trench 1, whereby quite obviously center point 142 can be marked on the ruler. The distance 17 between wire cable 12 and center point 142 corresponds exactly to the distance 10 down in the hole. By carrying out two measurements in orthogonal direction relative to one another the exact location of point 9, i.e. the exact deviation of the actual trench or bore hole centerline from the design centerline 7 can be obtained and corrective measures taken thereupon.

While there is shown and described a present preferred embodiment of the invention, it is to be distinctly understood that the invention is not limited thereto, but may be otherwise variously embodied and practiced within the scope of the following claims. ACCORDINGLY

What is claimed is:

1. In an apparatus for measuring the deviation of the run of the actual center axis of bore holes or trenches filled with bentonite relative to the design vertical center axis thereof, the excavation of said bore holes and trenches proceeding by utilization of bentonite fluid filling substantially completely said bore holes and said trenches such to back the side walls of said bore holes and said trenches to prevent a cave-in thereof, which apparatus comprises a gauge means arrestable inside said bore hole or said trench, a cable means for suspending and controlling said gauge means, a supporting frame means for supporting said gauge means, a tensioning device means to apply a predetermined tension force at one end of said cable means, and an instrument means to control the verticality of said cable means, an improvement comprising that said cable means includes a service cable means and a measuring cable means, said service cable means being interchangeable with said measuring cable means, said gauge means including a predetermined mass resulting in a force of gravity exceeding the tensile strength of said measuring cable means, wherein said gauge means includes a body provided with a plurality of circumferentially arranged protrusions for keeping said gauge means aligned within said bore hole or trench, said cylindrical body including a centrally arranged socket means open toward the top end of said body, a top section of said body being shaped in form of a funnel such to provide a guideway leading to said socket means, the improvement further comprising a plug means arranged to be suspended at one end from said cable means, which plug means is arranged to releasably lock into said socket means.

2. The apparatus as defined in claim 1, wherein said body is a cylindrical body.

3. The apparatus as defined in claim 2, wherein said socket means is a cylindrically shaped through bore extending coaxially of said cylindrical body and comprising an intermediate section of an enlarged diameter defining an abrupt change of cross-section and thus an abutment shoulder, and that said through bore comprises a lower section having converging side wall portions defining a stop.

4. The apparatus as defined in claim 1, wherein said plug means comprises a cylindrical main body and a coaxially to said main body extending cylindrical outer shell in which said main body is at least partly received, whereby said outer shell is axially movable relative to said main body.

5. The apparatus as defined in claim 4, wherein said main body comprises a section of reduced diameter and of predetermined axial length, further that said outer shell is provided at one end with an inwardly directed protrusion extending into said section of reduced diameter such that the extent of movement of said outer shell relative to said main body is limited between two end positions, the distance between which is determined by said predetermined axial length of said section of reduced diameter and wherein said main body is provided with a plurality of pawl means arranged circumferentially of said main body, whereby said main body is provided with a recessed section for receiving of said pawl means.

6. The apparatus as defined in claim 5, wherein each said pawl means comprises a plurality of pawl members hingedly connected to said main body and pivotable between a first position in which each said pawl member extends substantially parallel to the longitudinal axis of said main body and is substantially completely received within said recessed section, and a second position in which each of said pawl members projects obliquely out of said main body, and in that said main body is provided with spring means biassing each said pawl member into its second position.

7. The apparatus as defined in claim 6, wherein in the said first position of said pawl members said outer shell is in one of its said end positions and overlies and abuts each of said pawl members, keeping them against the force of said spring means located within said recessed section, and in the said second position of said pawl members said outer shell is in its other end position remote from said pawl members.

8. The apparatus as defined in claim 7, wherein in said second position of said pawl members said pawl members engage into said abutment shoulder of said through bore of said socket means such that said body of said gauge means is suspended by said plug means.

9. The apparatus as defined in claim 7, wherein said outer shell comprises a rim located oppositely to said end having said inwardly directed protrusion, whereby said rim is provided with inwardly extending latch-like projections, and that each said pawl member comprises an outer stepped portion defining a shoulder such that at said first end position of said pawl members said latch-like projections engage in said shoulders locking said pawl members in their first position, whereby said outer shell is kept in said overlying relationship relative to said pawl members thus allowing a retrieval of said plug means out of said socket means.

10. The apparatus as defined in claim 9, wherein said through bore of said socket means comprises a conically converging end section, further that the outer surface of the end section of said outer shell comprising said inwardly directed protrusion extends correspondingly conically such that said conical end section of said through bore forms an abutment for said outer shell, such that upon lowering said plug means down within said socket means said outer shell will abut at said end section of said through bore and thus will be arrested, whereby said main body will descend further causing said rim area of said outer shell to slide over said pawl members, thus forcing them into their said first position.

11. The apparatus as defined in claim 1, wherein said supporting frame means comprises an annular base plate means and a first turntable means rotatably supported by said base plate means, further comprises a slide means slidingly supported by said first turntable means, and further a second turntable means rotatably supported by said slide means, and that said second turntable means is provided with an elongated carrier means supporting a guide pulley means of said cable means.

12. The apparatus as defined in claim 11, wherein said annular base plate means is supported by a plurality of leg means straddling said bore hole or said trench, and is provided further with a first toothed pinion coupled to a pinion drive means, further that said first turntable means comprises a circular plate means having a toothed rim, whereby said first pinion engages into said toothed rim such that upon rotation of said first pinion said first turntable means rotates relative to said base plate means, further that said circular plate means of said first turntable means is provided with two parallel slide rail means and a toothed rack means extending alongside one of said slide rail means and an elongated opening being arranged between said two slide rail means, further that slide means is carried and guided by said slide rail means and is provided with a second toothed pinion coupled to a second pinion drive means, whereby said pinion engages into said toothed rack, such that upon rotation of said second pinion said slide means is shifted along said slide rail means, further that said slide means is provided with a third toothed pinion coupled to a third pinion drive means and that there is provided a second turntable means having an annular toothed rack, whereby said third toothed pinion engages into said annular toothed rack, such that upon rotation of said third toothed pinion said second turntable means rotates relative to said slide means, and in that said elongated carrier means extends through said elongated opening such that said guide pulley means is located below said base plate means.

13. The apparatus as defined in claim 1, wherein said instrument means comprises two elongated fastener means arranged at a distance from each other for engaging into said cable means at two distant points, which fastener means are lengthwise axially divided into two halves, further in that there are provided a clamping means each for said fastener means, which clamping means are in turn divided in two halves, whereby the corresponding halves of each of said clamping means are rigidly connected to each other by a frame member, and in that at least one of said two clamping means is provided with two level means extending orthogonally to each other.

14. The apparatus as defined in claim 13, wherein each of said two fastener means comprise a longitudinally extending bore provided with three longitudinally extending protrusions, each having a machined surface area for engagement into said cable means, and each of said two fastener means is provided with two circumferentially extending outer ribs arranged at a distance from each other for locating said clamping means therebetween, and wherein the mating surfaces of said halves of said clamping means extend in axial direction of said cable means and in that there are provided at each said clamping means two screw bolts connecting said two halves together.

15. The apparatus as defined in claim 14, wherein said clamping means is provided with a central opening, further in that there is provided an insert means split in two halves, which insert means is located within said central opening and whereby said fastener means is located in turn within said insert, such that a clamping force exerted by said clamping means is transferred by means of said insert means onto said fastener means.

16. The apparatus as defined in claim 15, wherein said insert means comprises two diametrically opposed cylindric outer surface sections and in that said central opening in said clamping means comprises two diametrically opposed cylindric inner surface sections, such that said insert means are rotatably arranged within said clamping means.

17. The apparatus as defined in claim 1, wherein said body is a prismatic body.

* * * * *